US010147991B1

(12) United States Patent
Wu et al.

(10) Patent No.: US 10,147,991 B1
(45) Date of Patent: Dec. 4, 2018

(54) NON-RECIPROCAL MODE CONVERTING SUBSTRATE INTEGRATED WAVEGUIDE

(71) Applicants: Ke Wu, Montreal (CA); Amir Afshaniaghajari, Montreal (CA)

(72) Inventors: Ke Wu, Montreal (CA); Amir Afshaniaghajari, Montreal (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 0 days.

(21) Appl. No.: 15/612,450

(22) Filed: Jun. 2, 2017

(51) Int. Cl.
*H01P 1/32* (2006.01)
*H01P 1/397* (2006.01)
*H01P 3/16* (2006.01)

(52) U.S. Cl.
CPC ..... *H01P 1/397* (2013.01); *H01P 1/32* (2013.01); *H01P 3/16* (2013.01)

(58) Field of Classification Search
CPC .. H01P 1/397; H01P 1/38; H01P 1/383; H01P 1/387; H01P 1/36; H01P 1/32; H01P 1/39; H01P 1/215; H01P 1/217; H01P 1/218
USPC ..... 333/1.1, 24.2, 208, 209, 239, 158
See application file for complete search history.

(56) References Cited

U.S. PATENT DOCUMENTS 3,071,740 A * 1/1963 Shinichiro ..... H01P 1/32 333/24.2
8,130,063 B2 * 3/2012 Chen ..... H01P 1/2088 333/208
2009/0002090 A1 * 1/2009 Pietig ..... H01P 1/38 333/24.2
2015/0333726 A1 * 11/2015 Xue ..... H01P 3/121 333/26

OTHER PUBLICATIONS

K. J. Button and B. Lax, "Theory of Ferrites in Rectangular Waveguides," IRE Transactions on Antennas and Propagation, vol. 4, No. 3, pp. 531-537, Jul. 1956.

* cited by examiner

*Primary Examiner* — Stephen E Jones

(57) ABSTRACT

A non-reciprocal mode converting SIW includes a first straight SIW section, a second straight SIW section, and a curved SIW section coupling the first straight SIW section to the second straight SIW section. The curved SIW section included magnetic biasing at opposed corner regions. The magnetic biasing and a curvature of the curved SIW section causes: (i) a wave in a first transverse electric (TE) mode that propagates in a forward direction from the first straight section through the curved SIW section into the second straight SIW section to convert to a second TE mode, and (ii) a wave in the first TE mode that propagates in a reverse direction from the second straight SIW section through the curved SIW section into the first straight SIW section to maintain the first TE mode.

20 Claims, 8 Drawing Sheets

NON-RECIPROCAL MODE CONVERTING SUBSTRATE INTEGRATED WAVEGUIDE

FIELD

This disclosure relates to substrate integrated waveguides, and in particular to a non-reciprocal mode converting substrate integrated waveguide.

BACKGROUND

The use of substrate integrated waveguide (SIW) circuitry for RF signal transmission can offer a planar, low profile alternative to traditional bulky, metallic waveguides and can be more efficient than two-wire cable or coaxial cable solutions in some applications. With SIW, relatively low-loss and high-Q waveguide structures can be realized as highly integrated planar microwave structures with compact size, at low cost, and with low interference due to the shielded environment.

It is possible to propagate several modes of electromagnetic (EM) waves within a waveguide. The physical dimensions of a waveguide determine the cutoff frequency for each mode. If the frequency of the impressed RF signal is above the cutoff frequency for a given mode, the electromagnetic energy can be transmitted through the guide for that particular mode with minimal attenuation. Otherwise the electromagnetic energy with a frequency below cutoff for that particular mode will be attenuated to a negligible value in a relatively short distance. The dominant mode in a particular waveguide is the mode having the lowest cutoff frequency. For a rectangular SIW this is the TE10 mode. The TE (transverse electric) signifies that all electric fields are transverse to the direction of propagation and that no longitudinal electric field is present. In some applications, a SIW structure that facilitates conversion from one EM wave mode to a different EM wave mode could be useful.

SUMMARY

Example embodiments are described of a SIW that converts EM energy from TE10 wave mode to a TE20 wave mode.

According to a first example aspect, a non-reciprocal mode converting SIW is provided that includes a first straight SIW section, a second straight SIW section, and a curved SIW section coupling the first straight SIW section to the second straight SIW section. The curved SIW section included magnetic biasing at opposed corner regions. The magnetic biasing and a curvature of the curved SIW section causes: (i) a wave in a first transverse electric (TE) mode that propagates in a forward direction from the first straight section through the curved SIW section into the second straight SIW section to convert to a second TE mode, and (ii) a wave in the first TE mode that propagates in a reverse direction from the second straight SIW section through the curved SIW section into the first straight SIW section to maintain the first TE mode.

In some example configurations, ferrite material is included at the opposed corner regions to provide the magnetic biasing, the ferrite material at one corner region providing a magnetic field bias in an opposite direction than the ferrite material at the other corner region. In some examples the ferrite material includes metal strips located between upper and lower planar ground planes of the SIW.

In examples of the first aspect, the first TE mode is TE10 and the second TE mode is TE20.

In some configurations, the ferrite material at an outer corner of the opposed corner regions has a curvature radius that exposes a propagating wave to the ferrite material at the outer corner for a first distance, the ferrite material at an inner corner of the opposed corner regions has a curvature radius that exposes a propagating wave to the ferrite material at the inner corner for a second distance, wherein the first distance is substantially equal to a sum of the second distance and one wavelength. In some examples, the ferrite material at the outer corner and the ferrite material at the inner corner each extend inward from opposed corner sides of the curved SIW section the same distance.

In some examples, in the reverse direction a wave in TE10 mode undergoes a 360 degree phase shift while passing through the curved SIW section. In example configurations of the first aspect, the first straight SIW section includes a first H-plane port at a terminal end thereof for exciting wave propagation in the forward direction in the first TE mode, and the second straight SIW section includes a second H-plane port in a terminal end thereof for exciting wave propagation in the second direction in the first TE mode.

The second straight SIW section can include a first E-plane slot formed through a ground plane thereof for extracting waves in the second TE mode from the second straight SIW section that result from wave propagation in the forward direction in the first TE mode. In some applications, the SIW is combined with a second SIW having a second E-plane slot formed through a ground plane thereof and coupled with the first E-plane slot to receive waves in the second TE mode extracted from the second straight SIW section.

According to a further example aspect is a method of non-reciprocal mode conversion using a SIW. In a forward propagating direction, the method includes: exciting TE10 mode waves in a first straight section of the SIW to propagate towards a curved section of the SIW; and bending the TE10 mode waves propagating in the curved section to convert the TE10 mode waves to TE20 mode waves in a second straight section of the SIW. In a reverse propagating direction, the method includes exciting TE10 mode waves in the second straight section to propagate towards the curved section; and bending and magnetically biasing the TE10 mode waves propagating in the curved section to maintain the TE10 mode waves as TE10 mode waves in the first straight section.

In some examples, bending and magnetically biasing the TE10 mode waves propagating in the curved section comprises causing a 360 degree phase shift in the TE10 mode waves. In some examples, the method also includes extracting TE20 mode waves from the second straight section though an E-plane slot in a ground plane of the second straight section.

According to another example aspect, a circulator is provided. The circulator includes a non-reciprocal mode converting substrate integrated waveguide (SIW) configured to: (i) in a forward propagating direction: excite waves in a first TE mode in a first straight section of the SIW to propagate towards a curved section of the SIW; and bend the waves propagating in the curved section to convert the waves to a second TE mode in a second straight section of the SIW; (ii) in a reverse propagating direction: excite waves in the first TE mode in the second straight section to propagate towards the curved section; and bend and magnetically bias the waves propagating in the curved section to maintain the waves in the first TE mode in the first straight section. The circulator also includes a second SIW coupled to the second straight section and configured to extract waves in the second TE mode from the second straight section.

In some configurations, the first straight section, second straight section and second SIW each have a respective H-plane port for exciting waves in the first TE mode. In some examples of the circulator, the curved section includes ferrite loading at opposed corner regions to provide magnetic biasing, the ferrite loading at one corner region providing a magnetic field bias in an opposite direction than the ferrite loading at the other corner region. The ferrite loading may for example include nickel ferrite strips located between upper and lower planar ground planes of the SIW.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Example embodiments of a non-reciprocal substrate integrated waveguide (SIW) where EM wave propagation occurs with different modes in forward and reverse directions will be described.

Figure 2:
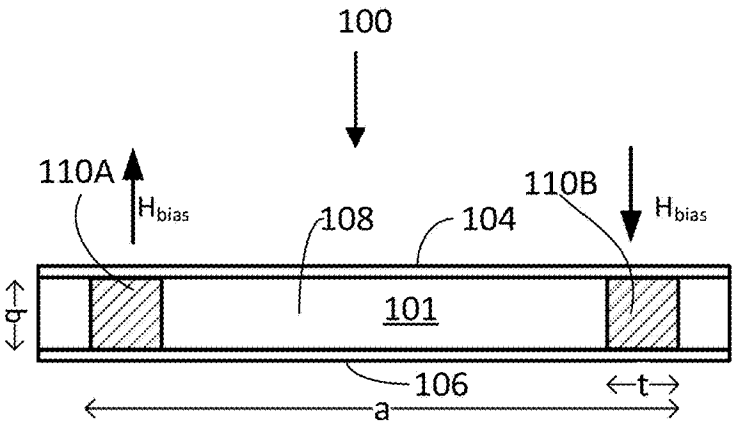
FIG. 2 is a sectional view taken along the lines II-II of FIG. 1.
Figure 1:
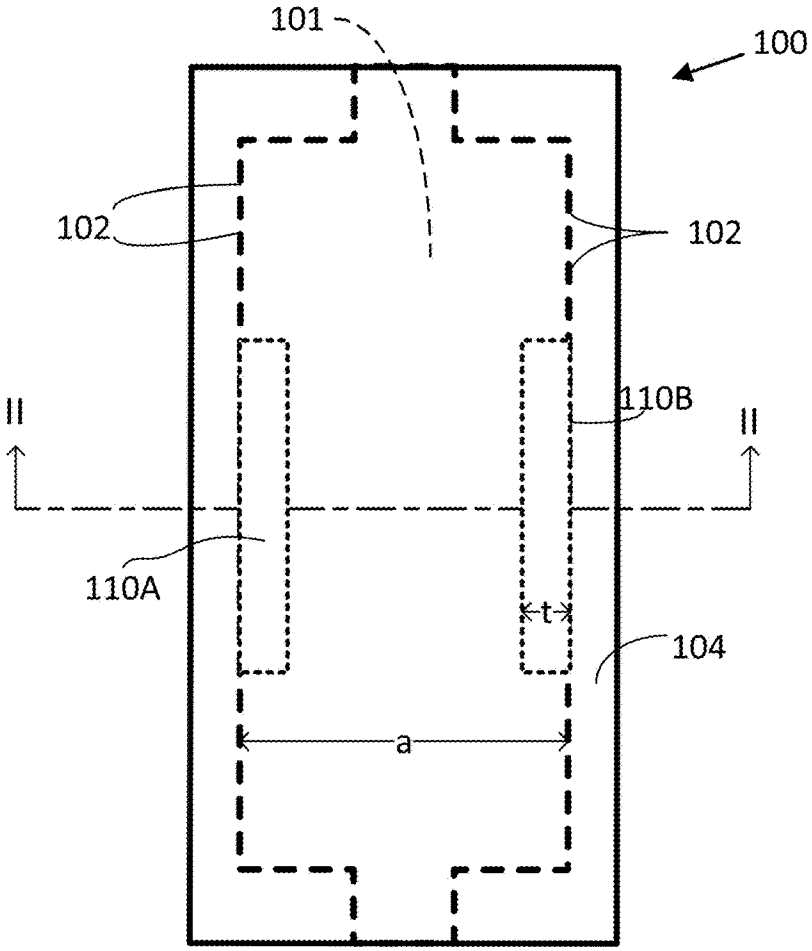
FIG. 1 is a top view of a rectangular substrate integrated waveguide (SIW) according to an example embodiment.

FIGS. 1 and 2 illustrate a rectangular SIW structure 100 to facilitate an understanding of the operation of example embodiments of the invention. As with conventional SIW structures, SIW structure 100 is a planar structure fabricated using two periodic rows of metallic vias (holes) or slots 102 connecting top and bottom metallic ground planes 104, 106 located on opposite sides of an intermediate dielectric substrate 108. As seen in FIGS. 1 and 2, the SIW structure 100 defines a SIW 101 that has a height "b" (corresponding to the height of substrate 108), and a width "a" (corresponding to the distance between the two rows of slots 102). SIW structure 100 differs from conventional SIW structures in that SIW structure 100 also includes a pair of ferrite loaded regions 110A,110B located in substrate 108 at opposite side edges of the SIW 101. As seen in FIGS. 1 and 2, each of the first and second ferrite loaded region 110A, 110B extends into the waveguide 101 a distance "t" from its respective edge of the waveguide. The ferrite loaded regions 110A, 110B are substantially identical except that they have opposite magnetic field biases. As illustrated in FIG. 2, the magnetic field bias $H_{bias}$ for the first ferrite loaded region 110A is directed in a first direction perpendicular to the waveguide plane, and the magnetic field bias $H_{bias}$ for the second ferrite loaded region 110A extends in a second, opposite direction perpendicular to the waveguide plane.

When ferrites at opposite sides of a waveguide are biased in opposite directions, the resulting waveguide will propagate waves in a non-reciprocal mode. Solving Maxwell equations for a rectangular waveguide loaded with ferrite results in pair of equations for electric (E) and magnetic fields (H). By imposing boundary conditions and manipulating the results, a characteristic equation is derived that can be solved to find the propagation wavenumber β in forward and reverse propagation directions. Since the equation is not linear, either side of equation can be divided into two functions of β, and solved graphically. The characteristic equation and location of roots (in regard to waveguide wavenumber k), dictates the application of a waveguide device. In the present disclosure, the solution of particular interest is the one that results in a non-reciprocal mode waveguide. In such a solution, one root is smaller than k and the other root is bigger than k. If β is smaller than k, then $k_a$ is real, imposing a sinusoidal variation of fields over a cross-section of the waveguide substrate region. On contrary, if β is bigger than k, then $k_a$ is imaginary which results in a hyperbolic variation of fields across the waveguide. This implies that in one propagation direction, fields are concentrated in a middle of waveguide (normal mode; β smaller than k) and in the other direction, fields are concentrated on the ferrite edge (edge mode; β bigger than k).

In this regard, the SIW structure 100 of FIG. 1 has been configured as a non-reciprocal mode waveguide. In one example, SIE structure 100 has the following parameters for a 6 GHz frequency:

TABLE 1

Design Parameters of Non-Reciprocal Mode Waveguide for 6 GHz

| Parameter | Value |
|---|---|
| a - width of waveguide | 21 mm |
| t - width of ferrite loaded region | 4 mm |
| ε_substrate - dielectric constant of substrate (substrate is Rogers 6010) | 10.2 |
| ε_ferrite - dielectric constant of ferrite loaded region (nickel ferrite) | 13.2 |
| $H_{bias}$ - magnetic field bias | 500 Oersteds |
| Ms - Magnetic flux density | 5000 Gauss |

Figure 4:
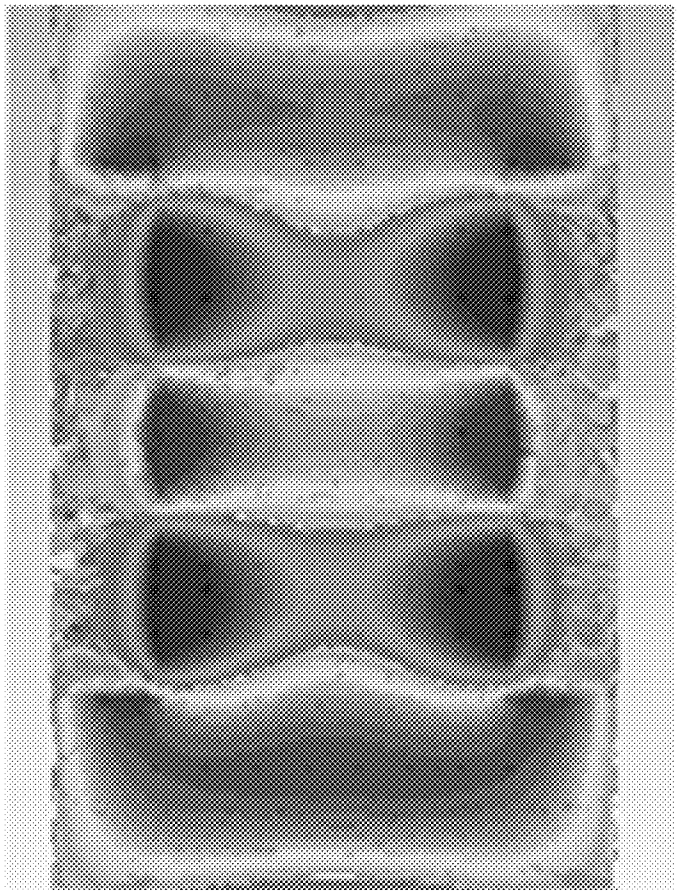
FIG. 4 illustrates an EM field pattern for an RF signal propagating in a reverse direction (edge mode) in the SIW of FIG. 1.
Figure 3:
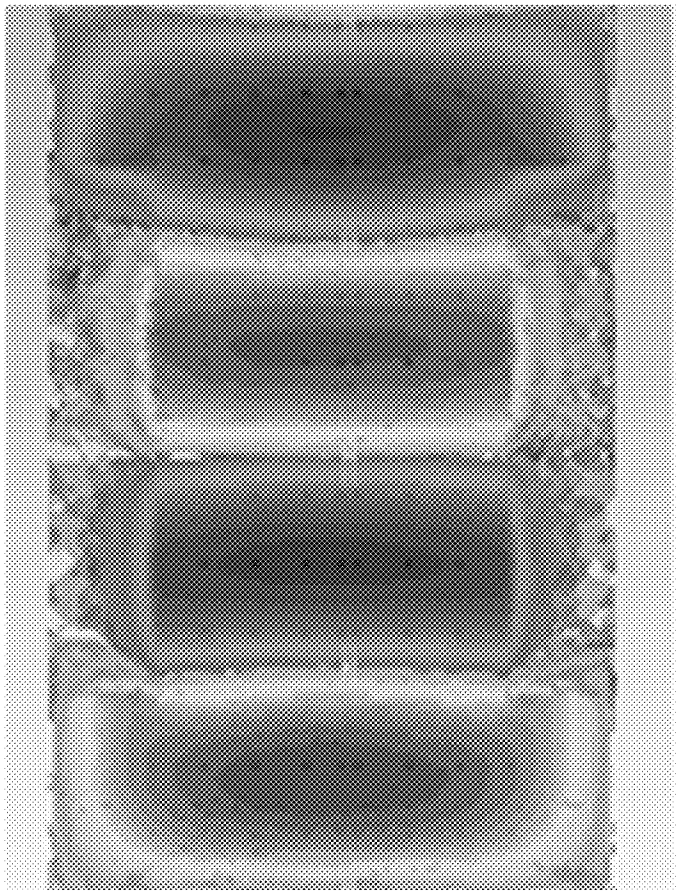
FIG. 3 illustrates an electrical field pattern for an RF signal propagating in a forward direction (normal mode) in the SIW of FIG. 1.

FIGS. 3 and 4 illustrate simulated results for SIW structure 100 in a forward direction (FIG. 3) and a reverse direction (FIG. 4), respectively. As can be seen in FIGS. 3 and 4, in the forward direction, the electrical field I and consequently the EM field) is concentrated in the middle of the wave guide (corresponding to normal mode), and in the reverse direction, the electrical field is concentrated at the sides of the waveguide (edge mode). Accordingly, FIGS. 3 and 4 illustrates a non-reciprocal mode of SIW structure 100.

In example embodiments, the ability of a ferrite loaded SIW to provide different propagation modes in forward and reverse directions is exploited to provide a non-reciprocal mode converting SIW. In this regard, FIGS. 5-8 illustrate a non-reciprocal mode converting SIW structure 200 according to example embodiments. SIW structure 200 is configured to preserve a dominant TE10 mode in one direction, but convert the TE10 mode into a TE20 mode in the opposite direction. In example embodiments, SIW structure 200 achieves its non-reciprocal mode converting abilities through a combination of ferrite loading and the inclusion of a bend in the waveguide.

As noted above, in the proper configuration, in reverse direction a ferrite loaded SIW can operate in an edge mode with the EM field being concentrated at the sides of the waveguide. Because the EM field is concentrated at the sides of the waveguide in reverse direction, a bend in the waveguide at the ferrite loaded regions will introduce some phase shift between wave components at the opposite sides of waveguide as the length of propagation is different due to the differences in the inner and outer curve radiuses. With a suitably configured bend, a 360 degree phase shift can be introduced at the outer side of the curve relative to the inner side of the curve with the result that the TE10 mode can preserved at the other end of the bend.

In contrast, waves propagating through the waveguide bend in the forward direction (normal mode) have their field concentrated in the middle of the waveguide and will not experience the same phase shift effect as waves in the reverse mode. Accordingly, a radius and angle of the bend can be selected to convert from TE10 mode to TE20 mode in the forward direction.

Figure 6:
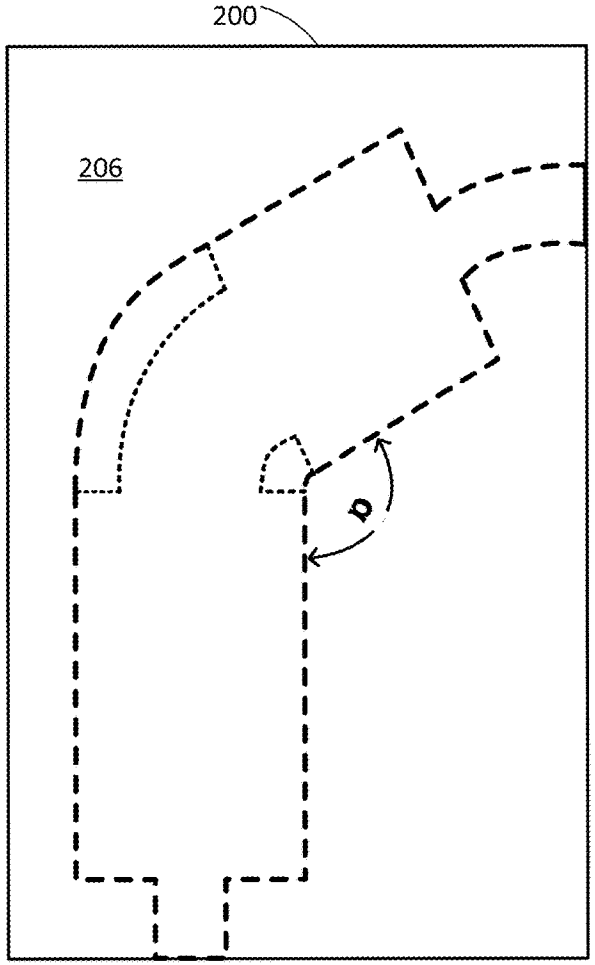
FIG. 6 is a bottom view of the non-reciprocal mode converting SIW of FIG. 5.
Figure 5:
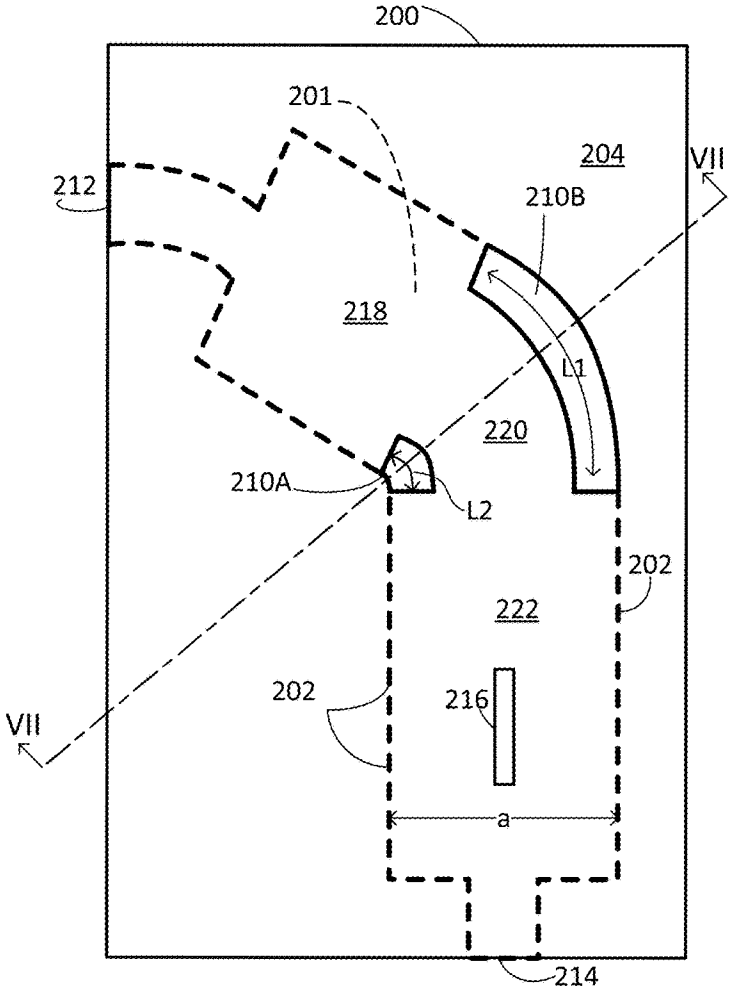
FIG. 5 is a top view of a non-reciprocal mode converting SIW according to an example embodiment.
Figure 8:
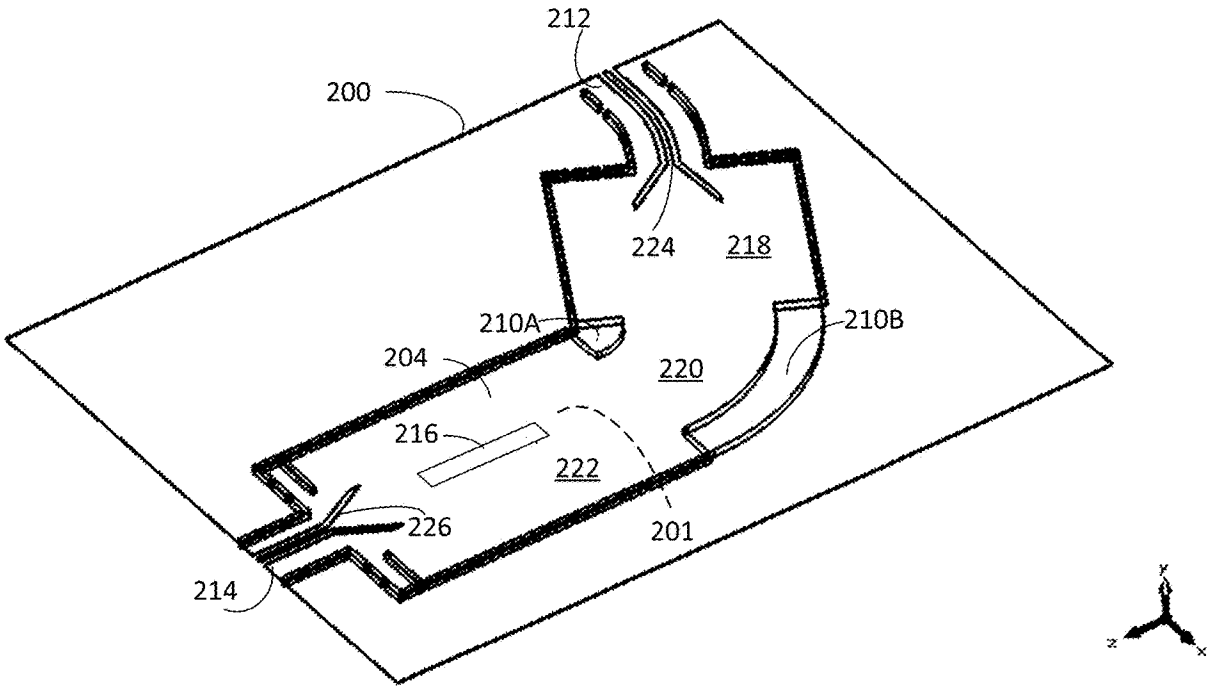
FIG. 8 is a perspective wireframe view of the non-reciprocal mode converting SIW of FIG. 5.

In this regard, as shown in the top and bottom views of FIGS. 5 and 6, respectively, and perspective view of FIG. 8, SIW structure 200 is configured with a curved section 220 that includes ferrite loaded inner and outer corner regions 210A, 210B, respectively. Curved section 220 couples a first straight section 218 that has a first H-plane port 212 at its terminal end and a second straight section 222 that has a second H-plane port 214 at its terminal end. Similar to SIW structure 100 discussed above, SIW structure 200 is a planar structure fabricated using two periodic rows of metallic vias (holes) or slots 202 connecting top and bottom metallic ground planes 204, 206 located on opposite sides of an intermediate dielectric substrate 208. The SIW structure 200 defines a SIW 201 that has a height "b" (corresponding to the height of substrate 208), and a width "a" (corresponding to the distance between the two rows of slots 202). In example embodiments, first port 212 and second port 214 each include a respective SIW to co-planar waveguide (CPW) transition element 224, 226 for transitioning between SIW signals and paired wire or coaxial cable line signals.

Figure 7:
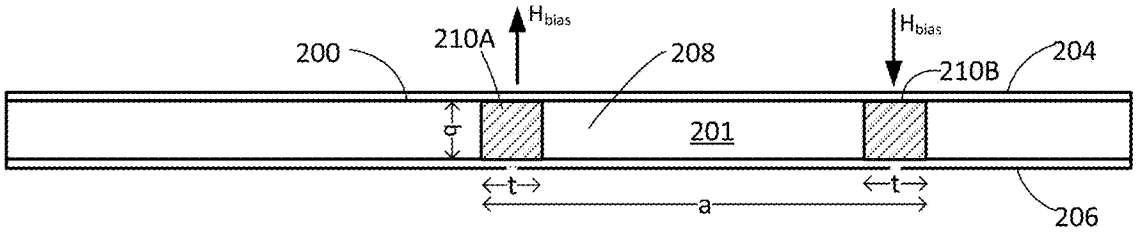
FIG. 7 is a sectional view taken along the lines VII-VII of FIG. 5.

As illustrated in FIG. 7, the magnetic field bias $H_{bias}$ for the inner corner ferrite loaded region 210A is directed in a first direction perpendicular to the waveguide plane, and the magnetic field bias $H_{bias}$ for the outer corner ferrite loaded region 210A extends in a second, opposite direction perpendicular to the waveguide plane. Ferrite loading can be accomplished by a variety of methods. In one example, ferrite loaded inner and outer corner regions 210A, 210B take the from of planar, curved ferrite strips placed directly on the substrate 201 in opposed corner regions of curved SIW section 220. In one such configuration, corresponding portions of the SIW structure 100 are cut out and substituted with the ferrite strips to achieve the desired dielectric constant and permeability. The ferrite strip regions 210A and 210B are then covered with metallic tape on both the top and bottom ground planes 204, 206. The metal tape covering the ferrite strip regions 210A and 210B is welded to the top and bottom ground planes 204, 206 to preserve the continuity of the ground planes. In example embodiments the ferrite strips are formed from nickel ferrite.

In another example embodiment, the dielectric 208 is embedded or doped with ferrite particles in the corner regions 210A, 210B to achieve a desired dielectric constant and permeability in those regions.

In an example embodiment, the angle of curvature of corner section 220 is selected such that the length L1 of the outer ferrite loaded region 210B that a propagating wave is exposed to is about one wave-length larger than the length L2 of inner ferrite strip. With such a configuration, in reverse direction (from second port 214 to first port 212) a wave at the outer side of curved section 220 undergoes 360 degree phase difference relative to a wave at the inner side, resulting in preservation of TE10 mode. Accordingly, as a result of the ferrite material at the edges of the corner section 220 of SIW 201, the radius of the curved section 220 does not affect mode in reverse direction. On the contrary, in the forward direction (from first port 212 to second port 214), the radius of curved section 220 causes a mode conversion from TE10 to TE20.

Table 2 below sets out example design parameters for the non-reciprocal mode converting SIW 200 for a 6 GHz frequency band:

TABLE 2

Design Parameters of Non-Reciprocal Mode Converting SIW for 6 GHz:

| Parameter | Value |
|---|---|
| a - width of waveguide | 21 mm |
| t - radial width of ferrite loaded region | 4 mm |
| ε_substrate - dielectric constant of substrate (substrate is Rogers 6010) | 10.2 |
| ε_ferrite - dielectric constant of ferrite loaded region (nickel ferrite) | 13.2 |
| $H_{bias}$ - magnetic field bias | 500 Oersteds |
| L1 - Length of outer ferrite loaded region (center to center length) | 21.93 mm (L2 plus λ, where λ = 19.05 mm @ 6 GHz) |
| L2 - Length of inner ferrite loaded region (center to center length) | 2.88 mm |
| Angle α between first straight section and second straight section | 62.5 degrees |
| Ms - Magnetic flux density | 5000 Gauss |

Figure 10:
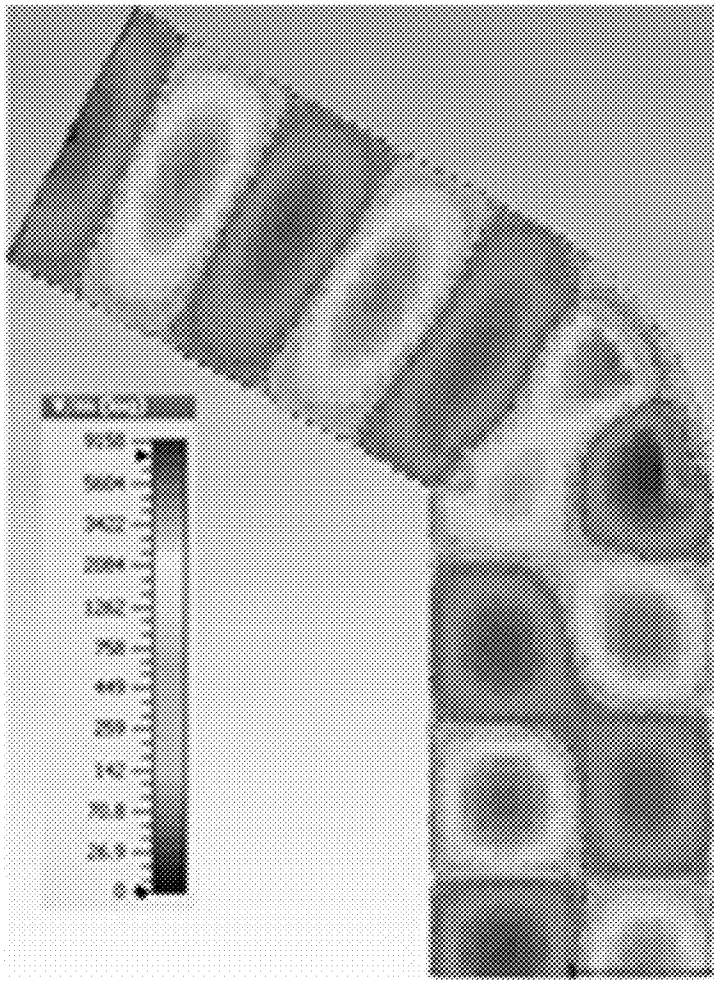
FIG. 10 illustrates an electrical field pattern for an RF signal propagating in a forward direction (normal mode) in the non-reciprocal mode converting SIW of FIG. 5.
Figure 9:
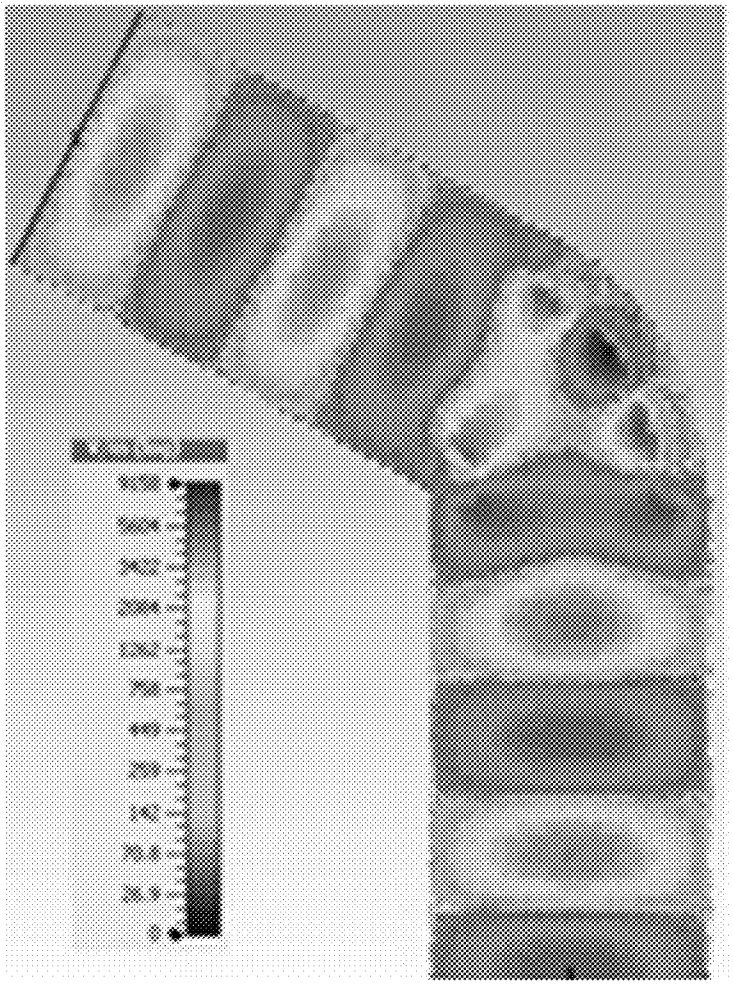
FIG. 9 illustrates an electrical field pattern for an RF signal propagating in a reverse direction (edge mode) in the non-reciprocal mode converting SIW of FIG. 5.

FIGS. 9 and 10 illustrate simulated results for SIW structure 200 in a reverse direction (FIG. 9) and a forward direction (FIG. 10), respectively. As can be seen in FIGS. 9 and 10, in the reverse direction from second port 214 to first port 212 (bottom to top in FIG. 9) the dominant TE10 mode is preserved. However, in the forward direction from first port 212 to second port 214 (top to bottom in FIG. 10), wave mode is converted to TE10 to TE20.

Figure 12:
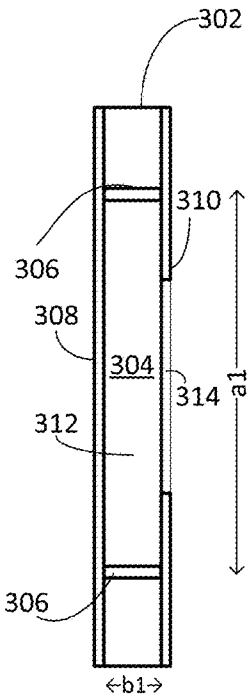
FIG. 12 is a sectional view of a further SIW layer that is part of the circulator of FIG. 11 for extracting a converted mode wave from a lower level SIW.
Figure 11:
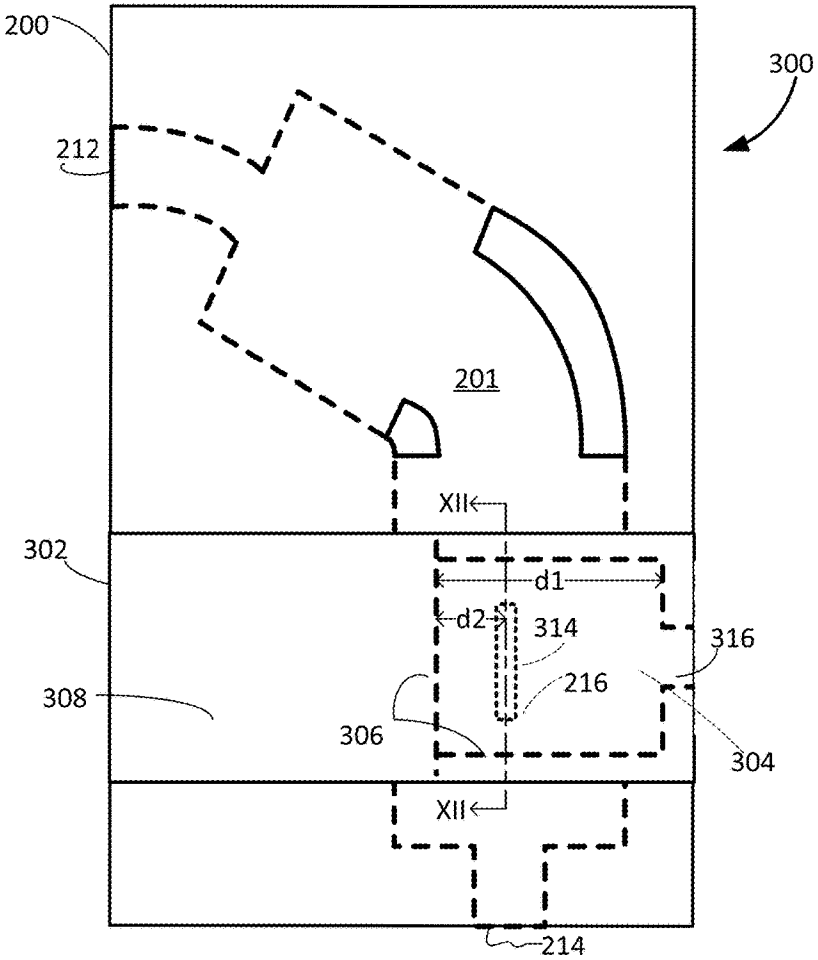
FIG. 11 is a top view of a circulator that incorporates the non-reciprocal mode converting SIW of FIG. 5, according to an example embodiment.
Figure 13:
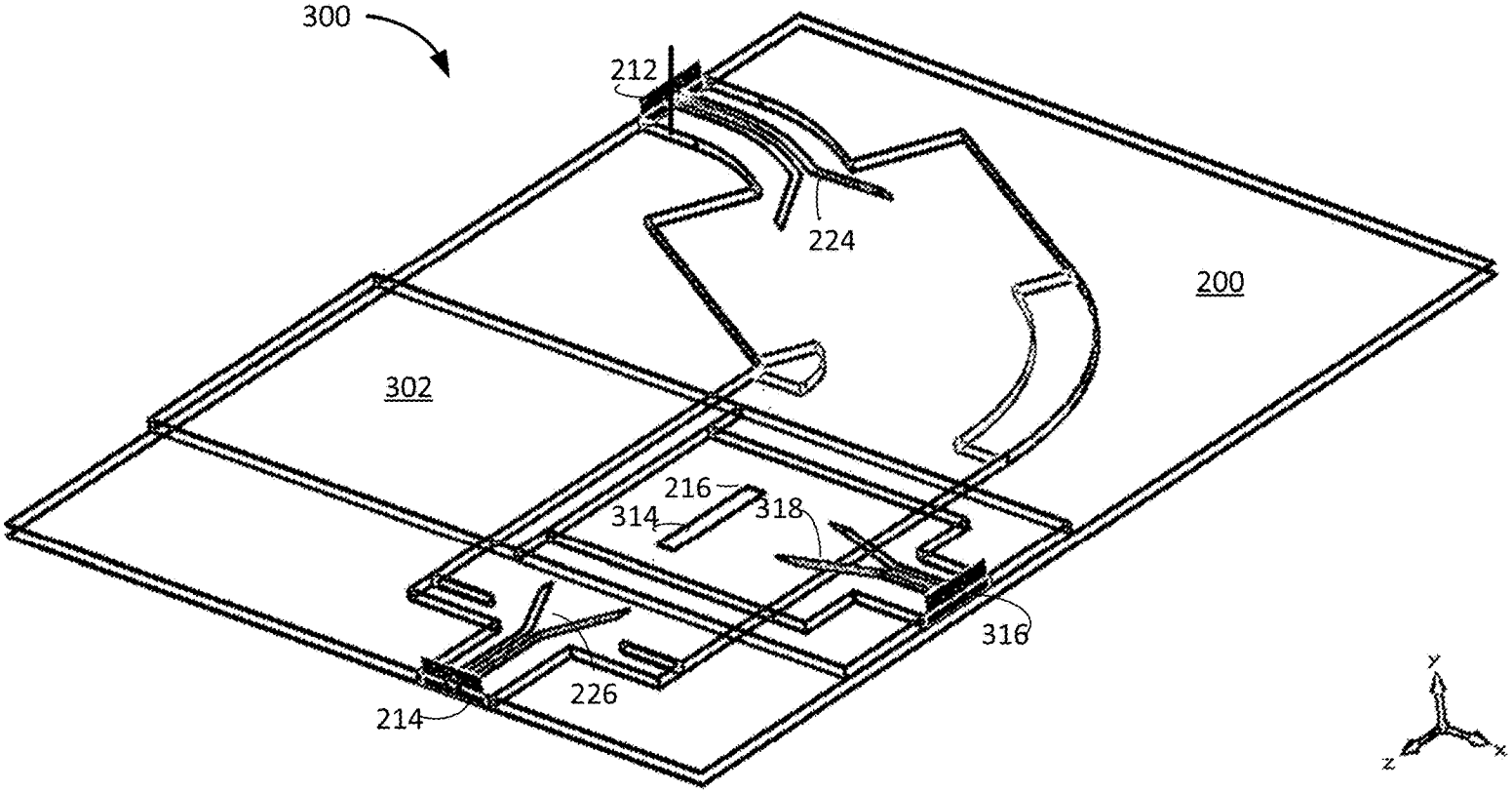
FIG. 13 is perspective wireframe view of the circulator of FIG. 11.

As will be appreciated, TE20 mode waves will be invisible to the H-plane port 214, and accordingly in some examples SIW structure 200 also includes an E-plane slot 216 through the upper metallic ground plane 204 in the second straight section 222 (e.g. between the curved ferrite regions 210A, 210B and the second H-plane port 214). E-plane slot 216 has an elongate axis that is parallel to the forward direction of SIW 201, and provides a means for TE20 mode waves to propagate from SIW 201. As illustrated in FIGS. 11 to 13, in an example embodiment, the SIW structure 200 is combined with a further SIW layer 302 that is located over E-plane slot 216 to extract the TE20 mode waves. The combination of SIW structure 200 and further SIW layer 302 forms a circulator 300.

As seen in the top view of FIG. 11, and sectional view of FIG. 12, further layer 302 is a planar structure having top and bottom metallic ground planes 308, 310 located on opposite sides of an intermediate dielectric substrate 312. A substantially rectangular SIW 304 is defined within the layer 302 by a series of periodic metallic vias or slots 306. SIW 304 has a height "bi" (corresponding to the height of substrate 312), a width "a1" (corresponding to the distance between opposing rows of slots 306), and a length of "d1". SIW 304 includes an E-plane slot 314 through its bottom ground plane 308 that is the same size as and is aligned with the E-plane slot 216 that is located on the top ground plane 204 of SIW structure 200. An H-plane port 316 is located at an end of the SIW 304. H-plane port 316, which functions as a third port to the circulator 300, is in a plane that is parallel to the second H-plane port 214 of SIW structure 200, but is oriented perpendicular to the second H-plane port 214. Third H-plane port includes a CPW transition element 318 (FIG. 13) for extracting the TE20 mode waves from SIW 101 to the upper layer SIW 304 (the extracted TE20 mode waves are converted to TE10 mode in SIW 304). In example embodiments the bottom ground plane 310 of upper SIW layer 302 is secured directly on and parallel to the top ground plane 204 of SIW structure 200, with E-plane slots 216, 314 in alignment, coupling the SIW 201 and SIW 304. Example design parameters for upper SIW layer 302 are set out below.

TABLE 3

Design Parameters of Upper SIW for 6 GHz Circulator

| Parameter | Value |
|---|---|
| a1 - width of waveguide | 15 mm |
| d1 - length of waveguide | 27.9 mm |
| ε_substrate - dielectric constant of substrate (substrate is Rogers 6010) | 10.2 |
| D2 - length of slot center to back wall of SIW 304 | 13.35 mm |

The three port circulator 300 has three potential propagation modes, each of which is non-reciprocal:

(1) Reverse Direction/Edge mode: TE10 mode wave is excited from second H-plane port 214 and propagates to first H-plane port 212. As wave passes through ferrite loaded curved section 220 it undergoes a 360 degree phase shift and TE10 mode is preserved and the first H-plane port 212 is excited. Third H-plane port 316 is isolated because E-plane slot 216 in SIW section 222 is orthogonal to TE10 mode wave excited from second H-plane port 214. Reverse direction/edge mode propagation is represented in FIG. 9.

(2) Forward Direction/Normal mode: TE10 mode wave is excited from first H-plane port 212 and propagates towards the second H-plane port 214. As the wave passes through ferrite loaded curved section 220 it is converted to TE20 mode because of the effect of the bend on the wave. Because the TE20 mode wave is orthogonal to second H-plane port 214 it is reflected back. As a result, second H-plane port 214 is isolated and a standing wave is formed in front the second H-plane port 214. The TE20 mode wave is absorbed through the coupled E-plane slots 216, 314. In SIW 304, the resulting wave is a TE10 mode wave that propagates to and excites third H-plane port 316. Forward direction/normal mode propagation is represented in FIG. 10

(3) Upper SIW layer excitation mode: Excitation of the third port 316 of the upper SIW 304 results in a TE20 mode wave in the SIW 201 that, in its original mode, is orthogonal to the second H-plane port 214. As the TE20 mode wave propagates towards first H-plane port 212 it passes through ferrite loaded curved section 220 in reverse direction, undergoing a 360 degree phase shift. TE20 mode is preserved such that the wave is orthogonal to first H-plane port 212 and reflected back. The reflected wave then passes through ferrite loaded curved section 220 again, but in reverse mode, and thus undergoes a conversion to TE10 mode. The reflected, converted TE10 mode wave then excites second H-plane port 214. However, the reflected, converted TE10 mode wave has experienced more losses than it would in either of the above two propagation modes due to its double pass through ferrite loaded curved section 220.

The above description provides an example of a non-reciprocal mode converting SIW, illustrated above as SIW structure 200. A non-reciprocal mode converting SIW can be used for many RF and microwave front end applications and applied to a variety of devices, including the circulator 300 described above, as well as to mode convertors and isolators, among other devices. In the illustrated example, mode is converted from TE10 mode into TE20 mode only in the forward direction, where in the reverse direction, the TE10 mode is unaffected.

Figure 14:
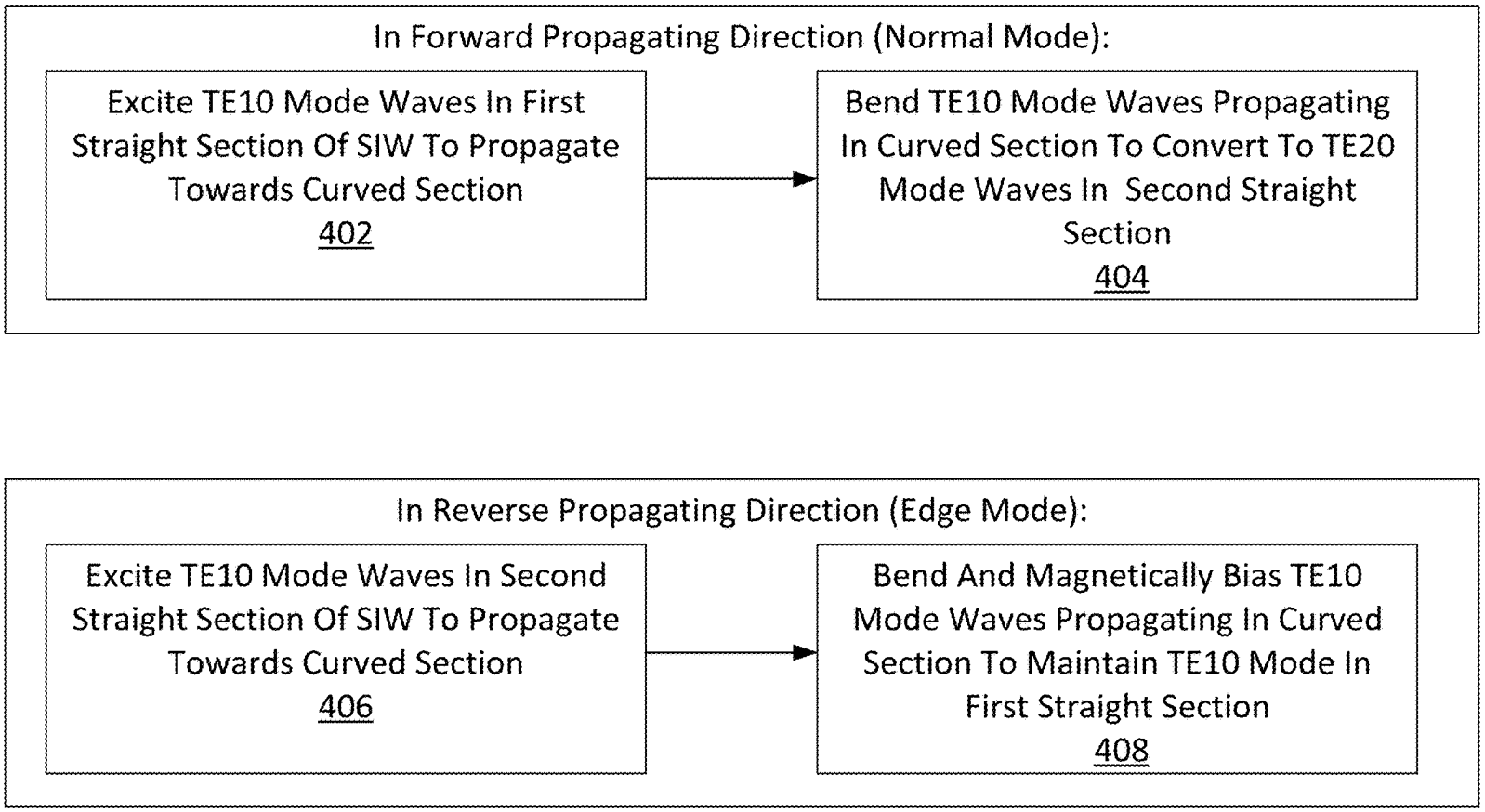
FIG. 14 is a block diagram illustrating a method of operating the non-reciprocal mode converting SIW of FIG. 5.

FIG. 14 is a block diagram summarizing a method of non-reciprocal mode conversion using the SIW structure described above. The method includes the following. In a forward propagating direction: exciting TE10 mode waves in a first straight section 218 of the SIW 201 to propagate towards a curved section 220 of the SIW 201 (step 402); and bending the TE10 mode waves propagating in the curved section 220 to convert the TE10 mode waves to TE20 mode waves in a second straight section 222 of the SIW 201 (step 404). The method further includes, in a reverse propagating direction: exciting TE10 mode waves in the second straight section 222 to propagate towards the curved section 220 (step 406); and bending and magnetically biasing the TE10 mode waves propagating in the curved section 220 to maintain the TE10 mode waves as TE10 mode waves in the first straight section 218 (step 408).

In at least some applications, the design described in respect of non-reciprocal mode converting SIW 200 can be used to provide a planar, low profile RF/microwave device that can be easily fabricated at a low cost. Although presented in the context of a 6 GHz band, the described structure can be configured for any RF frequency, providing multi-jurisdictional applications. The described SIW design exhibits unique non-reciprocal behavior. As non-reciprocity is favored in many transceiver and radar systems, especially in future 5G or possibly full duplex systems, many possible applications exist. Non-reciprocal, mode converting behavior has not been previously observed in a SIW.

Certain adaptations and modifications of the described embodiments can be made. Therefore, the above discussed embodiments are considered to be illustrative and not restrictive.

What is claimed is:

1. A non-reciprocal mode converting substrate integrated waveguide (SIW), comprising:

a first straight SIW section;

a second straight SIW section;

a curved SIW section coupling the first straight SIW section to the second straight SIW section, the curved SIW section including magnetic biasing at opposed corner regions, the magnetic biasing and a curvature of the curved SIW section causing: (i) a wave in a first transverse electric (TE) mode that propagates in a forward direction from the first straight section through the curved SIW section into the second straight SIW section to convert to a second TE mode, and (ii) a wave in the first TE mode that propagates in a reverse direction from the second straight SIW section through the curved SIW section into the first straight SIW section to maintain the first TE mode.

2. The SIW of claim 1 wherein ferrite material is included at the opposed corner regions to provide the magnetic biasing, the ferrite material at one corner region providing a magnetic field bias in an opposite direction than the ferrite material at the other corner region.

3. The SIW of claim 2 wherein the first TE mode is TE10 and the second TE mode is TE20.

4. The SIW of claim 3 wherein the ferrite material at an outer corner of the opposed corner regions has a curvature radius that exposes a propagating wave to the ferrite material at the outer corner for a first distance, the ferrite material at an inner corner of the opposed corner regions has a curvature radius that exposes a propagating wave to the ferrite material at the inner corner for a second distance, wherein the first distance is substantially equal to a sum of the second distance and one wavelength.

5. The SIW in claim 4 wherein the ferrite material at the outer corner and the ferrite material at the inner corner each extend inward from opposed corner sides of the curved SIW section a same distance.

6. The SIW of claim 2 wherein the ferrite material includes metal strips located between upper and lower planar ground planes of the SIW.

7. The SIW of claim 6 wherein in the reverse direction a wave in TE10 mode undergoes a 360 degree phase shift while passing through the curved SIW section.

8. The SIW of claim 7 wherein the first straight SIW section includes a first H-plane port at a terminal end thereof for exciting wave propagation in the forward direction in the first TE mode, and the second straight SIW section includes a second H-plane port in a terminal end thereof for exciting wave propagation in the second direction in the first TE mode.

9. The SIW of claim 8 wherein the second straight SIW section includes a first E-plane slot formed through a ground plane thereof for extracting waves in the second TE mode from the second straight SIW section that result from wave propagation in the forward direction in the first TE mode.

10. The SIW of claim 9 in combination with a second SIW having a second E-plane slot formed through a ground plane thereof and coupled with the first E-plane slot to receive waves in the second TE mode extracted from the second straight SIW section.

11. A circulator, comprising:

a non-reciprocal mode converting substrate integrated waveguide (SIW) configured to: (i) in a forward propagating direction: excite waves in a first TE mode in a first straight section of the SIW to propagate towards a curved section of the SIW; and bend the waves propagating in the curved section to convert the waves to a second TE mode in a second straight section of the SIW; (ii) in a reverse propagating direction: excite waves in the first TE mode in the second straight section to propagate towards the curved section; and bend and magnetically bias the waves propagating in the curved section to maintain the waves in the first TE mode in the first straight section; and a second SIW coupled to the second straight section and configured to extract waves in the second TE mode from the second straight section.

12. The circulator of claim 11 wherein the first straight section, second straight section and second SIW each have a respective H-plane port for exciting waves in the first TE mode.

13. The circulator of claim 12 wherein the second SIW and second straight section are coupled through respective E-plane slots formed through abutting ground planes thereof.

14. The circulator of claim 12 wherein the first TE mode is TE10 and the second TE mode is TE20.

15. The circulator of claim 14 wherein in the reverse propagating direction a wave in TE10 mode undergoes a 360 degree phase shift while passing through the curved SIW section.

16. The circulator of claim 14 wherein the curved section includes ferrite loading at opposed corner regions to provide magnetic biasing, the ferrite loading at one corner region providing a magnetic field bias in an opposite direction than the ferrite loading at the other corner region.

17. The circulator of claim 16 wherein the ferrite loading includes nickel ferrite strips located between upper and lower planar ground planes of the SIW.

18. A method of non-reciprocal mode conversion using a SIW, comprising:

in a forward propagating direction:

exciting TE10 mode waves in a first straight section of the SIW to propagate towards a curved section of the SIW; and bending the TE10 mode waves propagating in the curved section to convert the TE10 mode waves to TE20 mode waves in a second straight section of the SIW;

and in a reverse propagating direction:

exciting TE10 mode waves in the second straight section to propagate towards the curved section; and bending and magnetically biasing the TE10 mode waves propagating in the curved section to maintain the TE10 mode waves as TE10 mode waves in the first straight section.

19. The method of claim 18 wherein, in the reverse propagating direction, bending and magnetically biasing the TE10 mode waves propagating in the curved section comprises causing a 360 degree phase shift in the TE10 mode waves.

20. The method of claim 18 comprising extracting TE20 mode waves from the second straight section though an E-plane slot in a ground plane of the second straight section.

* * * * *